US011846060B2

(12) United States Patent
Kang

(10) Patent No.: US 11,846,060 B2
(45) Date of Patent: Dec. 19, 2023

(54) LAUNDRY TREATMENT APPARATUS AND CONTROL METHOD THEREOF

(71) Applicant: LG ELECTRONICS INC., Seoul (KR)

(72) Inventor: Jinkeun Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 226 days.

(21) Appl. No.: 17/045,258

(22) PCT Filed: Apr. 5, 2019

(86) PCT No.: PCT/KR2019/004097
§ 371 (c)(1),
(2) Date: Oct. 5, 2020

(87) PCT Pub. No.: WO2019/194650
PCT Pub. Date: Oct. 10, 2019

(65) Prior Publication Data

US 2021/0164143 A1 Jun. 3, 2021

(30) Foreign Application Priority Data

Apr. 6, 2018 (KR) ..... 10-2018-0040381

(51) Int. Cl.
*D06F 33/42* (2020.01)
*D06F 33/46* (2020.01)
(Continued)

(52) U.S. Cl.
CPC ..... *D06F 33/42* (2020.02); *D06F 33/34* (2020.02); *D06F 33/44* (2020.02); *D06F 33/46* (2020.02);
(Continued)

(58) Field of Classification Search
CPC ..... D06F 33/42; D06F 33/34; D06F 33/44; D06F 33/46; D06F 33/47; D06F 39/08;
(Continued)

(56) References Cited

U.S. PATENT DOCUMENTS

2007/0113595 A1* 5/2007 Harwood ..... D06F 39/087 68/12.01
2015/0252510 A1* 9/2015 Heo ..... D06F 34/16 68/12.14
(Continued)

FOREIGN PATENT DOCUMENTS

JP 2004-232606 8/2004
JP 3744052 B2 * 2/2006
(Continued)

OTHER PUBLICATIONS

International Search Report dated Jul. 26, 2019 issued in Application No. PCT/KR2019/004097.
(Continued)

*Primary Examiner* — Michael E Barr
*Assistant Examiner* — Pallavi Chitta
(74) *Attorney, Agent, or Firm* — KED & Associates LLP

(57) ABSTRACT

The present disclosure relates to a laundry treatment apparatus and a control method thereof. The laundry treatment apparatus includes a tub providing a space in which washing water is stored, a drum, a drain pump, a control unit controlling water supply and drain and determining a drain state, and a pump control unit changing and controlling an operation speed of the drain pump depending on the drain state and is configured to drain the washing water by repeating a process of decreasing and then increasing a speed of the drain pump depending on a speed set by the pump control unit, such that the wash water does not remain and may be effectively drained, and noise generated due to
(Continued)

a flow of residual water and an operation of the drain pump may be eliminated.

8 Claims, 6 Drawing Sheets

(51) Int. Cl.

| | |
|---|---|
| ***D06F 33/47*** | (2020.01) |
| ***D06F 33/44*** | (2020.01) |
| ***D06F 33/34*** | (2020.01) |
| ***D06F 39/08*** | (2006.01) |
| *D06F 103/42* | (2020.01) |
| *D06F 103/18* | (2020.01) |
| *D06F 103/16* | (2020.01) |
| *D06F 105/08* | (2020.01) |
| *D06F 103/14* | (2020.01) |
| *D06F 34/08* | (2020.01) |

(52) U.S. Cl.
CPC ..... *D06F 33/47* (2020.02); *D06F 39/08* (2013.01); *D06F 34/08* (2020.02); *D06F 2103/14* (2020.02); *D06F 2103/16* (2020.02); *D06F 2103/18* (2020.02); *D06F 2103/42* (2020.02); *D06F 2105/08* (2020.02)

(58) Field of Classification Search
CPC .. D06F 34/08; D06F 2103/14; D06F 2103/16; D06F 2103/18; D06F 2103/42; D06F 2105/08; D06F 39/083; D06F 2103/48
See application file for complete search history.

(56) References Cited

U.S. PATENT DOCUMENTS

2016/0115632 A1* 4/2016 Jung ..... D06F 33/38 68/12.05
2017/0302208 A1 10/2017 Je et al.

FOREIGN PATENT DOCUMENTS

| | | | |
|---|---|---|---|
| JP | 4682166 | B2 * | 5/2011 |
| KR | 10-1995-0018845 | A | 7/1995 |
| KR | 20-0133050 | | 4/1999 |
| KR | 10-2000-0002304 | | 1/2000 |
| KR | 10-2011-0112486 | | 10/2011 |
| KR | 10-1756408 | | 7/2017 |

OTHER PUBLICATIONS

Korean Notice of Allowance dated Jun. 1, 2023 issued in Application 10-2018-0040381.

* cited by examiner

LAUNDRY TREATMENT APPARATUS AND CONTROL METHOD THEREOF

CROSS-REFERENCE TO RELATED PATENT APPLICATIONS

This application is a U.S. National Stage Application under 35 U.S.C. § 371 of PCT Application No. PCT/KR2019/004097, filed Apr. 5, 2019, which claims priority to Korean Patent Application No. 10-2018-0040381, filed Apr. 6, 2018, whose entire disclosures are hereby incorporated by reference.

BACKGROUND OF THE DISCLOSURE

Field of the Disclosure

The present disclosure relates to a laundry treatment apparatus and a control method thereof.

Related Art

In general, a laundry treatment apparatus refers to an apparatus that separates contaminants from clothes, bedclothes or the like (hereinafter, abbreviated as "laundry") using a chemical decomposition action of water and a detergent and a physical action such as friction between the water and the laundry.

A top loading-type laundry treatment apparatus includes a cabinet, a tub provided in the cabinet and having an inlet port on an upper surface thereof, a drum rotatably provided in the tub, and a door opening and closing the inlet port. In addition, a door connected to the tub so as to open and close an opened upper side of the tub and a top cover covering the tub at portions other than a portion where the door is disposed may be disposed on the upper side of the tub.

Such a laundry treatment apparatus removes contamination of the laundry by repeatedly supplying and draining washing water to and from the drum. The laundry treatment apparatus drains the washing water after washing or after rinsing.

The laundry treatment apparatus includes a drain pump in a drain passage formed below the tub, and drains the washing water in the tub by an operation of the drain pump.

However, the washing water is not completely drained and a part of the washing water remains in the drain passage, such that residual water may be generated.

When the washing water remains, the drain pump continuously operates in order to remove the residual water. However, since an amount of washing water is small and an amount of load acting on the drain pump is different depending on an amount of residual water, the residual water is not normally drained.

Accordingly, there is a problem that noise is generated due to a flow of the residual water and the operation of the drain pump. In addition, there is a problem that drain is not completed, and the drain pump continuously operates, such that energy is wasted.

SUMMARY

An object of the present disclosure is to provide a laundry treatment apparatus that determines a residual water situation in which a part of washing water remains and controls a drain pump and drains the washing water, and a control method thereof.

In order to achieve the above object, a laundry treatment apparatus according to the present disclosure includes: a tub providing a space in which washing water is stored; a drum rotatably in the tub; a water level sensor detecting a water level of the washing water accommodated in the tub; a drain unit including a drain pump to drain the washing water; and a control unit determining a drain state in response to the water level detected by the water level sensor and controlling the drain unit, wherein the drain unit drains the washing water by repeating a process of increasing or decreasing a speed of the drain pump when a part of the washing water is not drained and remains.

According to the present disclosure, a laundry treatment apparatus includes: a tub having a drum provided therein and providing a space in which washing water is stored; a water level sensor detecting a water level of the washing water; a control unit determining a drain state for whether or not drain is normally performed in response to a change in the water level of the washing water detected by the water level sensor; a drain pump draining the washing water; and a pump control unit changing an operation speed of the drain pump depending on a speed of the drain pump or a current value applied to the drain pump when a part of the washing water is not drained and remains according to the determination of the drain state by the control unit, wherein the drain pump repeats a process of decreasing and then increasing the operation speed depending on a setting of the pump control unit and drains the washing water, when residual water is generated.

The pump control unit may decrease the speed of the drain pump in a first unit and increase the speed of the drain pump in a second unit smaller than the first unit.

The pump control unit may store a speed of the drain pump at which the washing water is drained without the residual water, and operate the drain pump at the stored speed at the next operation.

The pump control unit may set a limit speed range for the drain pump, and allow the drain pump to operate within the limit speed range.

In addition, a control method of a laundry treatment apparatus according to the present disclosure includes: operating a drain pump to drain washing water accommodated in a tub; detecting a water level of the washing water accommodated in the tub to determine a drain state; changing a speed of the drain pump by increasing or decreasing the speed of the drain pump when a part of the washing water is not drained and remains; repeating the changing of the speed of the drain pump; and draining all of the washing water to complete the drain.

In addition, according to the present disclosure, a control method of a laundry treatment apparatus includes: operating a drain pump to drain washing water accommodated in a tub; determining a drain state for whether or not the drain is normally performed in response to a change in a water level of the washing water accommodated in the tub; changing an operation speed of the drain pump depending on an operation state of the drain pump when a part of the washing water is not drained and remains according to a determination result of the drain state; repeating a process of decreasing and then increasing the operation speed of the drain pump; and completing the drain of the washing water.

The changing of the operation speed of the drain pump may include: increasing the speed of the drain pump in a first unit; and decreasing the speed of the drain pump in a second unit smaller than the first unit.

In the laundry treatment apparatus and a control method thereof according to the present disclosure configured as described above, the wash water does not remain and is effectively drained by controlling the drain pump.

In the present disclosure, drain and an operation state of the drain pump may be determined in response to the water level of the washing water detected during drain and a rotation speed of the drain pump and the rotation speed of the drain pump may be increased or decreased. In the present disclosure, the residual water may be removed and noise generated due to a flow of the residual water and an operation of the drain pump may be eliminated, by controlling the drain pump. In the present disclosure, change levels of an increase speed and a decrease speed of the drainage pump may be set to be different from each other to set a speed of the drain pump appropriate for the drain and complete the drain in a short time.

In the present invention, energy may be saved and a washing time can be shortened by controlling an unnecessary operation of the drain pump through the removal of the residual water.

DESCRIPTION OF EXEMPLARY EMBODIMENTS

Figure 1:
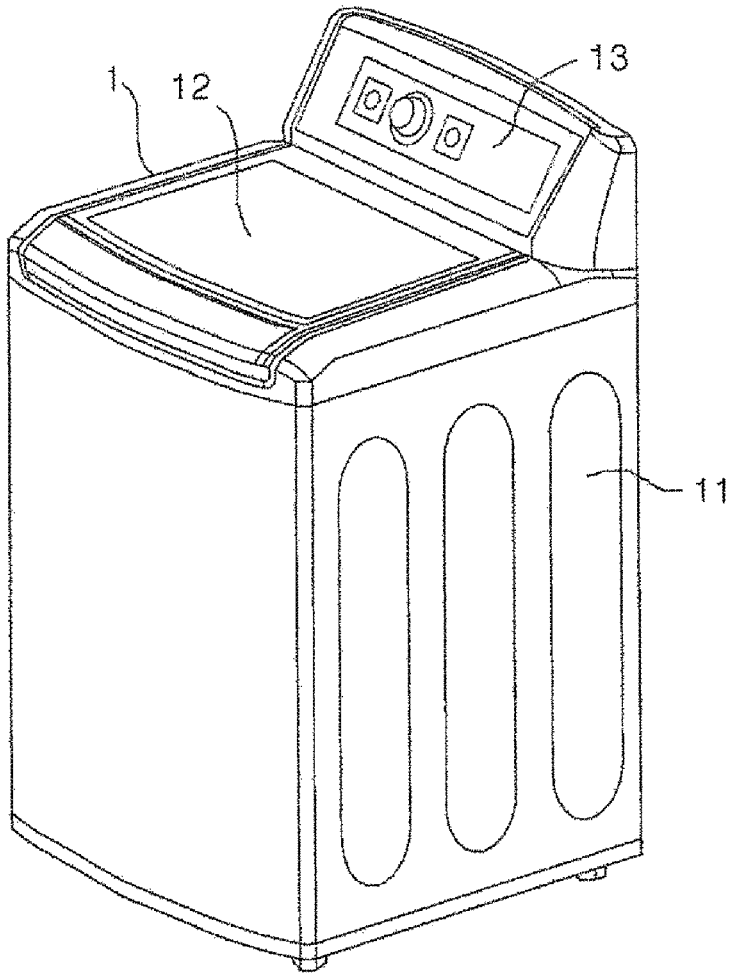
FIG. 1 is a perspective view of a laundry treatment apparatus according to an embodiment of the present disclosure.

Various advantages and features of the present disclosure and methods accomplishing them will become apparent from the following detailed description of embodiments with reference to the accompanying drawings. However, the present disclosure is not limited to embodiments to be described below, but may be implemented in various different forms, these embodiments will be provided only in order to make the present disclosure complete and allow those skilled in the art to completely recognize the scope of the present disclosure, and the present disclosure will be defined by the scope of the claims. Throughout the specification, like reference numerals denote like elements. In addition, a control unit and each unit of the present disclosure may be implemented by one or more processors and may be implemented by hardware apparatuses.

Hereinafter, the present disclosure will be described with reference to the drawings for describing a laundry treatment apparatus by embodiments of the present disclosure.

Figure 2A:
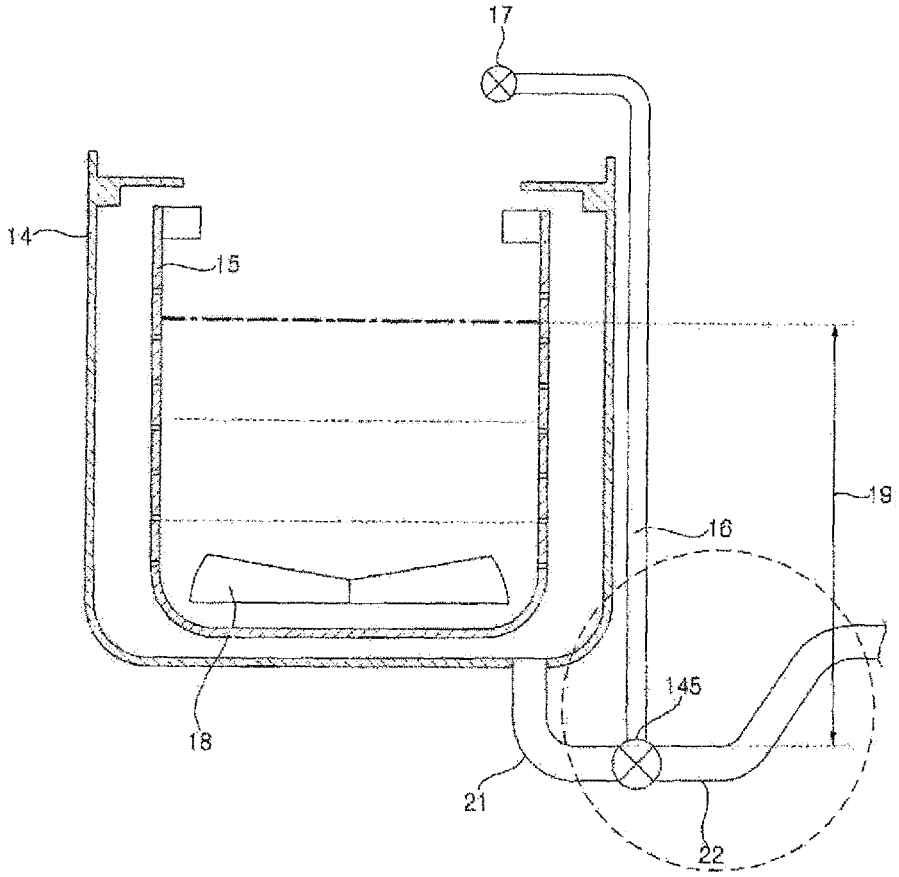
FIGS. 2A and 2B are cross-sectional views schematically illustrating an internal configuration of the laundry treatment apparatus according to an embodiment of the present disclosure.
Figure 2B:
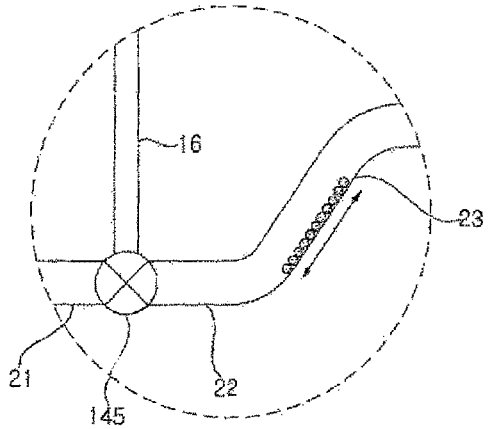

FIG. 1 is a perspective view of a laundry treatment apparatus according to an embodiment of the present disclosure, and FIG. 2 is a cross-sectional view schematically illustrating an internal configuration of the laundry treatment apparatus according to an embodiment of the present disclosure.

Referring to FIGS. 1 and 2, a laundry treatment apparatus 1 according to the present exemplary embodiment may include a cabinet 11 forming an appearance and a door 12 opening and closing an upper portion of the cabinet 11.

In addition, the laundry treatment apparatus 1 is provided with a control panel 13 disposed above the cabinet 11. The control panel 13 includes an operation unit inputting a washing setting such as a washing course and a display displaying an operation state.

The laundry treatment apparatus 1 may include a tub 14 disposed in the laundry treatment apparatus and providing a space in which washing water is stored, a drum 15 rotatably provided in the tub and providing a space in which laundry is stored, a water supply unit (not illustrated) supplying the washing water to the tub, and a drain unit draining the washing water stored in the tub to the outside of the cabinet 11.

The drum 15 is disposed rotatably in the tub 14. The drum according to the present embodiment has a cylindrical shape whose upper side is opened. The opened upper side of the drum is disposed below a clothing inlet port of the tub.

The drum 15 has a plurality of communication holes (not illustrated) formed in a bottom surface and a circumferential surface thereof and allowing an inner portion of the drum and the tub to communicate with each other. The drum 15 rotates in the tub by a drive unit (not illustrated). At least one washing protrusion portion (not illustrated) protruding from the bottom surface forming a water flow at the time of rotation of the drum is formed on the bottom surface of the drum according to the present embodiment.

In addition, the laundry treatment apparatus 1 may further include a pulsator 18 rotatably provided in the drum 15 and at a lower side of the drum 15.

A motor drive unit (not illustrated) provides a driving force for rotating the drum 15.

Meanwhile, when the pulsator 18 is provided, the motor drive unit provides a driving force for rotating the pulsator 18.

The motor drive unit may selectively transfer the driving force to allow only the drum 15 to be rotated or allow only the pulsator 18 to be rotated, and a clutch (not illustrated) may be provided so that the drum 15 and the pulsator 18 are simultaneously rotated.

The water supply unit is provided with a water supply valve (not illustrated) regulating a water supply passage (not illustrated) to supply the washing water into the drum 15.

The drain unit drains the washing water accommodated in the drum 15 and the tub 14 to the outside.

The drain unit includes drain passages 21 and 22 and drains the washing water in the tub 14 through the drain passages. In addition, the drain unit is provided with a drain valve (not illustrated) regulating the drain passages 21 and 22 and a drain pump 145 pumping the washing water, and the washing water is drained by an operation of the drain pump 145.

In addition, the drain unit includes a circulation passage 16 and a valve. The drain unit may allow a part of the washing water to flow through the circulation passage 16 to re-supply a part of the washing water to the tub 14. In this case, the drain pump operates as a circulation pump, and a separate circulation pump may be further provided, if necessary.

The drain pump 145 drains the washing water to the outside of the laundry treatment apparatus 1 through the drain passages 21 and 22 depending on a rotation direction of the drain pump 145, and allows the washing water to be re-supplied to a washing tub through the circulation passage 16.

A spray nozzle 17 is provided at a distal end of the circulation passage 16, such that the water that is circulated and re-supplied may be sprayed in a spray manner.

If the washing water is supplied into the washing tub through the water supply passage, a water level sensor (not illustrated) detects a water level 19 of the washing water. In this case, the water level sensor measures a position of the washing water in the drum based on a position of the drain passage as the water level 19 of the washing water.

As illustrated in (b) of FIG. 2, the drain unit drains the washing water in the tub 14 to the outside through the drain passages 21 and 22 by an operation of the drain pump 145.

When the washing water is not circulated and is drained depending on the rotation direction of the drain pump 145, the washing water is drained to the outside through a second drain passage 22.

In this case, residual water may be generated in the second drain passage 22. The residual water may move up and down in the second drain passage 22 by an operation of the drain pump. When the residual water is not drained and remains and flows in the drain passage, noise may be generated.

Accordingly, the drain unit controls the drain pump 145 to remove the residual water in the drain passage. Since the residual water in the drain channel is removed, the noise is decreased.

Figure 3:
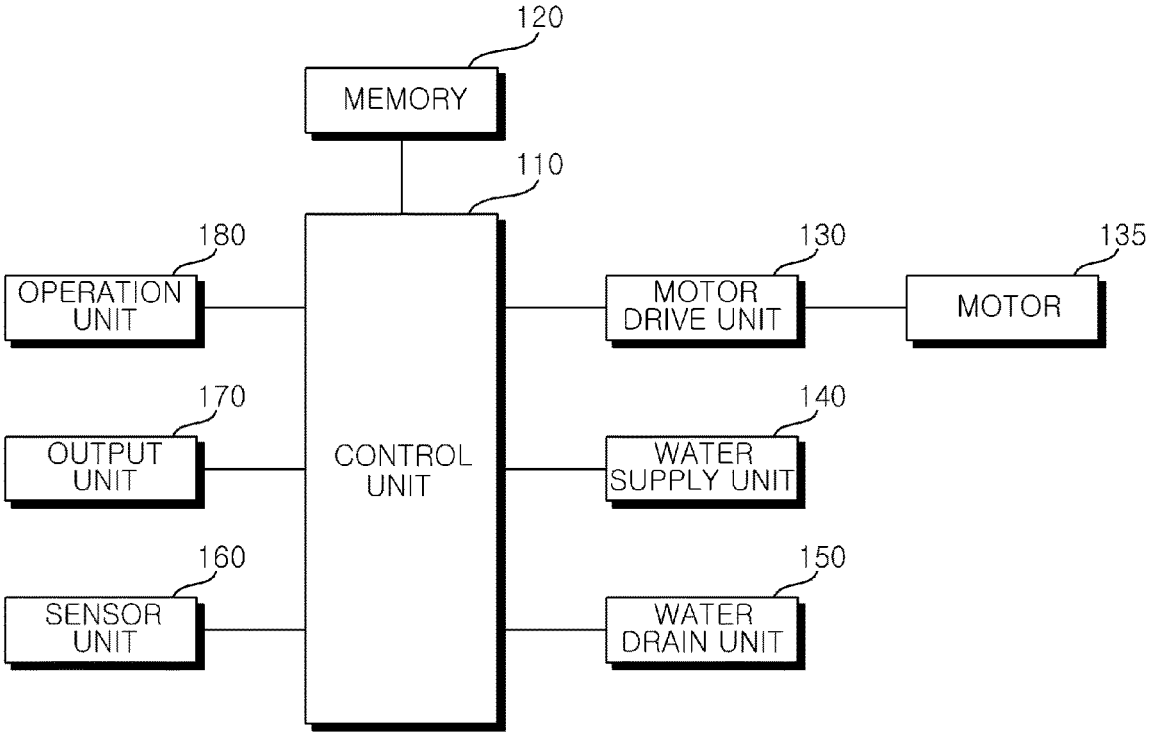
FIG. 3 is a block diagram schematically illustrating a control configuration of the laundry treatment apparatus according to an embodiment of the present disclosure.

FIG. 3 is a block diagram illustrating a control configuration of the laundry treatment apparatus according to an embodiment of the present disclosure.

As illustrated in FIG. 3, the laundry treatment apparatus 1 includes an operation unit 180, an output unit 170, a sensor unit 160, a motor drive unit 130, a water supply unit 150, a drain unit 140, a memory 120, and a control unit 110 controlling an overall operation.

In addition, the laundry treatment apparatus 1 may further include a communication unit (not illustrated) including a plurality of communication modules and connected to a terminal, an external server or the like to transmit and receive data to and from the terminal, the external server or the like. The communication unit may include communication modules such as Wi-Fi and WiBro as well as short-range wireless communication such as ZigBee and Bluetooth to transmit and receive data.

The operation unit 180 includes input means such as at least one button, switch, and touch pad installed on the control panel 13. The operation unit 180 inputs an operation setting including settings such as a power input, an operation mode, a type of laundry, a washing course, a water level, and a temperature. If the type of laundry is selected and a power key is input, the operation unit 180 inputs data on the operation setting to the control unit 110.

The output unit 170 outputs information on the operation setting and an operation state. The output unit 170 includes a display displaying the data in a combination of at least one of characters, number icons, images, and special characters on a screen, a lamp indicating an operation state depending on whether or not the lamp is turned on, and a speaker or a buzzer outputting a predetermined sound effect or warning sound.

The display may include a menu screen for the operation setting and operation control of the laundry treatment apparatus, and may output a guide message or a warning composed of a combination of at least one of characters, numbers, and images for the operation setting or the operation state.

The output unit 170 may output a warning sound according to occurrence of an abnormality when the abnormality occurs during operation, and may output an error code for the occurring abnormality.

The memory 120 stores control data for operation control of the laundry treatment apparatus, input operation setting data, data on an operation time calculated depending on the setting, data on a washing course, and data for determining whether or not an error has occurred.

In addition, the memory 120 stores data generated while the laundry treatment apparatus is operating or detected through the sensor unit 160 and data transmitted and received through the communication unit 390.

The memory 120, which stores data that may be read by a micro processor, may include a read only memory (ROM), a random access memory (RAM), and a flash memory, and may also include a hard disk drive (HDD), a solid state disk (SSD), a silicon disk drive (SDD), a compact disk (CD)-ROM, a magnetic tape, a floppy disk, an optical data storage apparatus.

In addition, the laundry treatment apparatus 1 includes a power supply unit (not illustrated) that converts supplied commercial power to supply operation power. The power supply unit cuts off an over-current, rectifies and smoothes the supplied power to generate the operation power having a predetermined magnitude, and supplies the operation power to each unit.

The sensor unit 160 may include a plurality of sensors to measure a voltage or a current in the laundry treatment apparatus 1, detect a temperature and a water level of the washing water, and detect a rotation speed of a motor 135. In addition, the sensor unit 160 may further include a laundry detection sensor (not illustrated) detecting a state or a material of the laundry. A temperature sensor (not illustrated) detects an internal temperature and a water temperature of the laundry treatment apparatus 1. When a heater is provided in the laundry treatment apparatus, the temperature sensor may detect a temperature of the heater. A plurality of temperature sensors are provided and are installed at different positions, respectively, to detect the temperature. A water level sensor detects a height (water level) of the water supplied to the tub. A current sensor detects a current applied to the motor 135, and a door sensor detects whether the door is opened or closed.

The motor drive unit 130 applies the current to the motor 135 and controls the motor to rotationally operate. The motor drive unit 130 controls an operation of the motor by converting the power supplied through the power supply unit into power for rotationally operating the motor 135 and applying the converted power to the motor 135. The motor drive unit may include an inverter for driving the motor.

The motor drive unit 130 controls a rotation direction, a rotation angle, and a rotation speed of the motor 135 according to a control command from the control unit 110. The motor drive unit 130 controls the motor 135 to operate differently depending on a set washing course and performed washing, rinsing, and dewatering. The motor drive unit 130 controls the rotation direction, the rotation angle, and the rotation speed of the motor 135 to be different, thereby allowing the washing water in the drum 15 to form a specific type of water flow.

The motor 135 is connected to the drum 15 to transfer a torque. In addition, the motor 135 may transfer the torque so that the pulsator rotationally operates.

The water supply unit 150 allows cold and hot water to be supplied according to washing and rinsing processes. The water supply unit 150 controls an amount of supplied water by controlling opening/closing of a water supply valve (not illustrated).

The water supply unit 150 allows the water to be continuously supplied or stopped after being supplied for a predetermined time depending on a point in time at which an operation is performed, that is, whether washing is being performed or rinsing is being performed or depending on an operation pattern of the drum.

The drain unit 140 may include drain pipes disposed below the tub 14 and forming the drain passages 21 and 22 and the drain pump 145 pumping the washing water flowing through the drain passages 21 and 22 to the outside of the laundry treatment apparatus 1. The drain unit 140 controls opening/closing of a drain valve (not illustrated) and controls an operation of the drain pump 145 to allow the water to be drained to the outside through the drain passages.

In addition, the drain unit 140 may be connected to the circulation passage 16 to allow a part of the washing water to be re-supplied to the drum 15 through the circulation valve, as described above.

The control unit 110 controls a series of washing processes such as washing, rinsing, dewatering, and drying. Hereinafter, it is clarified that performing the washing represents all operations including a washing process, a rinsing process, a dewatering process, and a drying process. The drying process may be applied differently depending on whether or not the laundry treatment apparatus includes a drying function.

The control unit 110 stores input operation settings in the memory 120, and calls water level and temperature settings and operation patterns according to a washing course in response to data stored in the memory to control an operation. The control unit 110 allows the operation settings or an operation state to be output through the output unit 170.

The control unit 110 applies a control command to the motor drive unit 130 to allow the drum to be rotated according to an operation of the drive unit, thereby performing the washing. The control unit 110 allows the washing water in the drum to form a predetermined type of water flow by an operation of the motor. In addition, the control unit 110 applies a control command to the heater (not illustrated) to allow the heater to operate, thereby heating the washing water or performing the drying process.

The control unit 110 controls the water supply unit 150 and the drain unit 140 to perform water supply to and drain from the tub depending on the operation setting. The control unit 110 may detect the water level of the washing water, determine whether or not the detected water level reaches a set water level within a predetermined time to determine whether or not the water supply is normally performed or whether or not the drain is normally performed, and output an error according to an abnormality in the water supply or the drain when there is an abnormality in the water supply or the drain.

In addition, when the washing water is drained after the washing or the rinsing, the control unit 110 may determine whether there is residual water and control the drain unit.

The control unit 110 determines the residual water based on the water level detected by a water level sensor 161.

The control unit may calculate a difference between a control speed for controlling the drain pump provided in the drain unit and an actual speed of the drain pump, and determine that there is an abnormality in the drain if the speed difference is equal to or greater than a set value. The control unit determines that the drain pump is in a speed ripple state where the washing water flows in the drain passage and is not normally drained, if the speed difference is equal to or greater than the set value.

In addition, the control unit 110 may analyze a current value measured through a current detecting unit and determine a residual water state through a ripple of the current value When the residual water remains, noise is generated by the operation of the drain pump for discharging the residual water. In this case, a ripple appears in the current value.

The control unit 110 determines whether or not the drain pump is in a ripple state for the washing water at a predetermined period to determine whether or not there is residual water, and controls the drain unit depending on whether or not there is residual water.

The drain unit 140 controls the drain pump to vary the speed of the drain pump according to a control command from the control unit.

Figure 4:
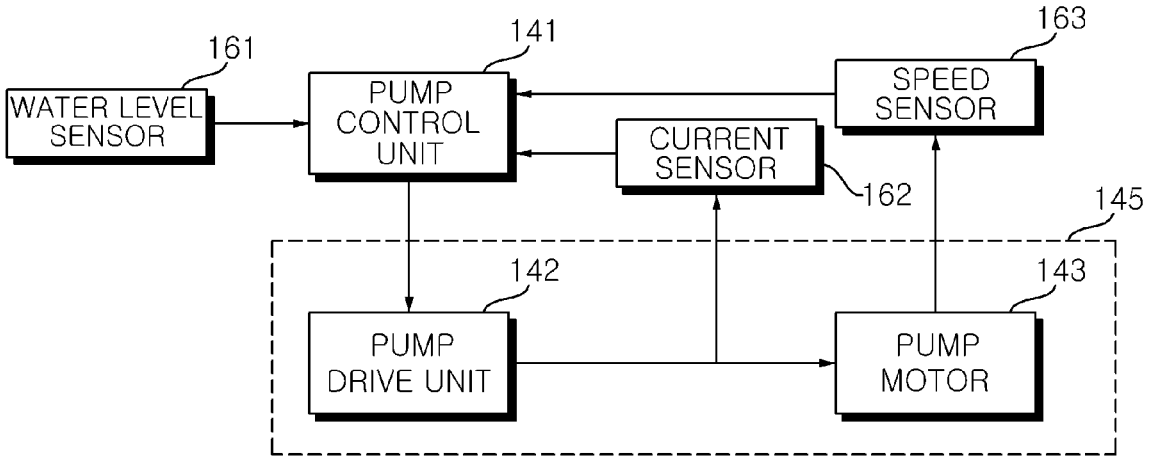
FIG. 4 is a reference diagram for describing pump control for draining washing water of the laundry treatment apparatus of FIG. 3.

FIG. 4 is a reference diagram for describing pump control for draining washing water of the laundry treatment apparatus of FIG. 3.

As illustrated in FIG. 4, the control unit 110 controls the drain unit 140 to drain the washing water after the washing or the rinsing.

The control unit 110 may determine a drain state based on the water level input from the water level sensor 161 and a ripple of a current value detected from a current sensor 162, and determine whether or the there is residual water.

The drain unit 140 controls the drain pump 145 according to the control command of the control unit 110 to drain the washing water through the drain passages 21 and 22. In addition, the drain unit 140 controls the operation of the drain pump 145 in response to the water level detected by the water level sensor 161 and the ripple of the current detected by the current sensor 162.

The drain unit 140 includes the drain pump 145 including a pump drive unit 142 and a pump motor 143. In addition, the drain unit 140 includes a pump control unit 141, a speed sensor 163, and the current sensor 162.

The pump control unit 141 applies a control signal for controlling the operation of the drain pump 145 to the drain pump 145 according to a control command from the control unit 110. In addition, the pump control unit 141 may control opening/closing of the drain valve at the time of reception of a drain command according to a control command from the control unit.

The pump control unit 141 turns on and off the operation of the drain pump, sets a rotation speed of the pump motor of the drain pump 145, and applies a control signal to the pump drive unit 142.

The speed sensor 163 detects a rotation speed of the pump motor and applies the detected rotation speed to the pump control unit 141, when the pump motor 143 rotationally operates.

Operation power having a predetermined magnitude is applied from the pump drive unit 142 to the pump motor 143 according to the control signal from the pump control unit 141. In this case, the current sensor 162 detects a current applied to the pump motor and applies the detected current to the pump control unit 141.

The current sensor is connected to both ends of a resistor for detecting a current, outputs a predetermined signal if a potential difference across the resistor is equal to or greater than a set value, amplifies the output signal in a predetermined amplification ratio, and applies the amplified output signal as a detected value to the pump control unit.

The pump control unit 141 applies a control signal for controlling the operation of the drain pump 145 to the drain pump 145 according to a control command from the control unit 110.

The pump control unit 141 determines a drain progress state depending on the water level value detected by the water level sensor 161.

The pump control unit 141 determines an operation state of the drain pump in response to data detected by the speed sensor 163 and the current sensor 162, and determines whether or not the drain pump 145 operates according to the control signal.

In addition, the pump control unit may determine whether or not the drain is normally performed, and apply data on the drain state to the control unit 110.

The pump drive unit 142 operates according to the control signal applied from the pump control unit to apply the operation power having a voltage and a current having a predetermined magnitude to the pump motor 143. Accordingly, the pump motor 143 operates at a rotation speed set based on the operation power applied from the pump drive unit.

The pump drive unit 142 supplies the operation power having a predetermined magnitude to the pump motor through switching control according to the control signal from the pump control unit 141. The pump drive unit may be composed of a switching circuit controlling the pump motor in a pulse width modulation (PWM) manner.

The pump control unit 141 may determine whether or not there is residual water depending on a water level value detected by the water level sensor 161 and a current of the current sensor. The pump control unit 141 may determine whether or not there is residual water by calculating consumed power based on the detected current value. Since a small amount of water is continuously drained during dewatering after the drain is completed, it may be determined that there is residual water.

The pump control unit may receive data at a predetermined period to determine the drain state and determine whether or not there is residual water of the washing water.

The pump control unit 141 controls a speed of the drain pump depending on a speed ripple according to a residual water state. If the rotation speed of the pump motor of the drain pump is detected through the speed sensor 163, the pump control unit 141 may control the speed of the drain pump by applying the control signal to the pump drive unit in response to the detected rotation speed.

The pump control unit 141 determines that the speed ripple has been generated and controls the speed of the drain pump, if a value obtained by subtracting a target speed from a current speed, that is, a difference value between the current speed and the target speed is equal to or greater than a set value, based on the detected speed.

The speed ripple is a state where a speed change is large, and may be determined as a state where an operation of the drain pump is currently unstable or abnormal. The operation of the drain pump is controlled depending on the target speed. When control for the drain pump is not normally performed, the difference between the current speed and the target speed increases. This phenomenon is due to a fluctuation in a load applied to the drain pump in the residual water state, and may occur since the water is not normally drained and the residual water flows in the drain passage due to a small amount of water. Therefore, the noise may be generated. In particular, as an amount of water drained during dewatering decreases, a state of the drain pump may become the speed ripple state.

The pump control unit 141 determines whether or not there is residual water depending on a set period, and increases or decreases the speed of the drain pump depending on the difference between the detected speed (current speed) and the target speed. The pump control unit 141 decreases the speed when it is determined that the speed ripple has been generated, and increases the speed when the drain pump is not in the speed ripple state. For example, when the drain pump is in the speed ripple state, the pump control unit 141 may decrease the speed by 100 rpm, and when the drain pump is not in the speed ripple state, the pump control unit 141 may increase the speed by 20 rpm.

The pump control unit 141 controls the target speed within a limit speed range for the target speed. For example, when the pump control unit decreases the target speed, in a case where the decreased target speed is less than a first limit speed, which is a minimum value within the limit speed range that may be set, the pump control unit sets the first limit speed as the target speed. In addition, when the pump control unit increases the target speed, in a case where the increased target speed exceeds a second limit speed, which is the maximum value within the limit speed range, the pump control unit sets the second limit speed (maximum value) as the target speed.

When the residual water is generated, the noise may be generated particularly due to the residual water, as described above, and thus, the pump control unit 141 performs control to increase or decrease the speed of the pump motor, as described above.

The pump drive unit 142 operates the pump motor according to the control signal, and the speed of the pump motor is changed by the control signal, such that the residual water of the washing water is drained through the drain passage.

Accordingly, the pump control unit 141 may increase or decrease the speed of the pump motor to set an optimum speed for the drain pump in a state where there is residual water and decrease the noise.

The pump control unit may store a speed at which the washing water is drained, and set the drain pump so that the drain pump operates based on the stored rate at the next operation.

The pump control unit 141 transmits data on the drain state to the control unit 110 at a predetermined period during drain. The control unit 110 may determine whether or not a drain error occurs depending on the drain state, output an error code at the time of occurrence of the drain error, and output a warning sound according to the occurrence of the error.

Figure 5:
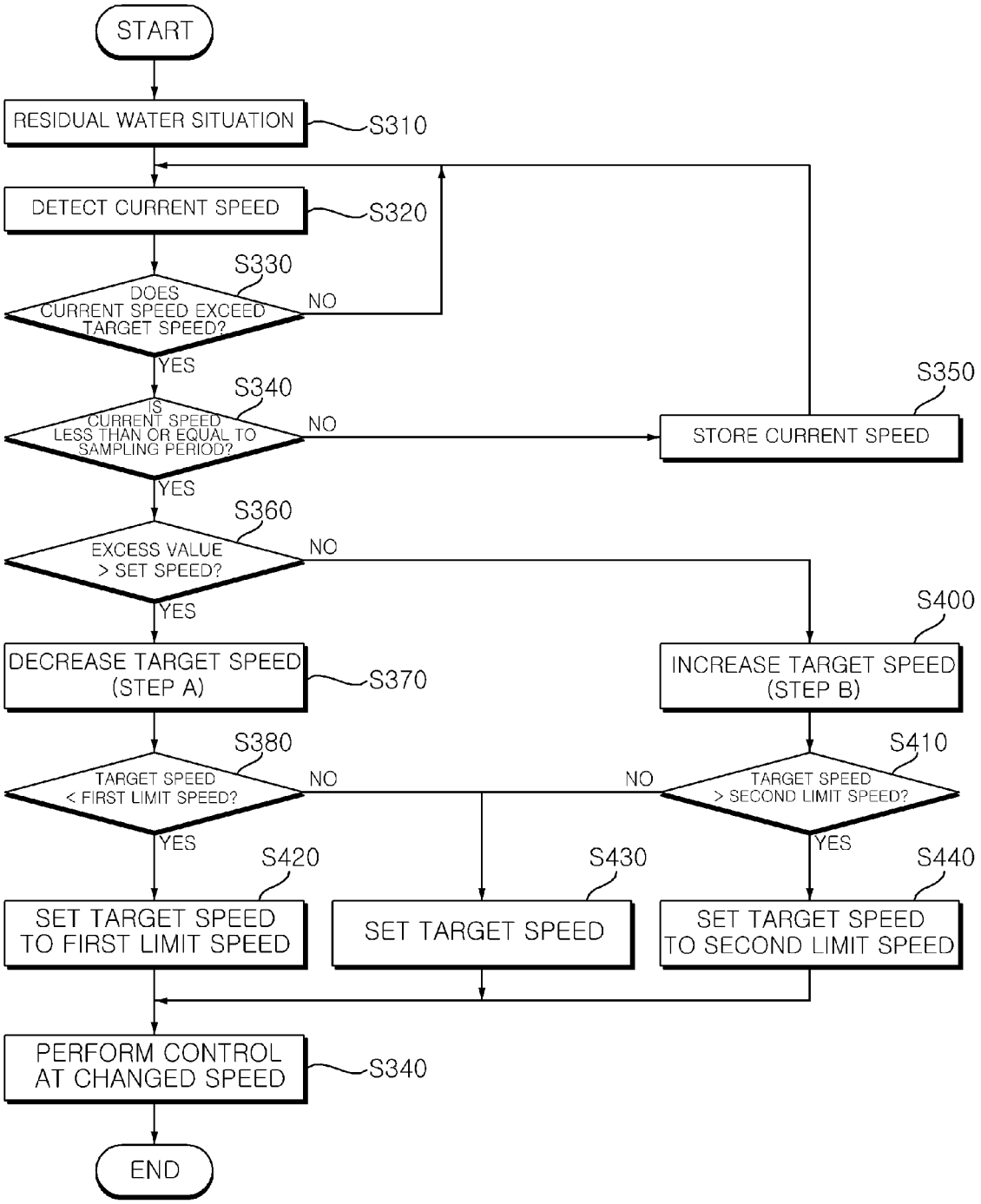
FIG. 5 is a flowchart illustrating a pump control method of the laundry treatment apparatus according to an embodiment of the present disclosure.

FIG. 5 is a flow chart illustrating a pump control method of the laundry treatment apparatus according to an embodiment of the present disclosure.

As illustrated in FIG. 5, the laundry treatment apparatus 1 drains the washing water in the tub 14 if the washing is completed or the rinsing is completed.

The control unit 110 controls the drain unit 140 to drain the washing water.

The drain unit 140 operates the drain valve and the drain pump 145 according to the control command of the control unit 110 to drain the washing water through the drain passage.

The water level sensor 161 periodically detects the water level of the washing water in the tub 14. In addition, the current sensor 162 detects the current applied to the pump motor 143 by the drain pump, that is, the pump drive unit 142.

The control unit 110 may calculate a water level change over time with respect to the water level of the washing water detected by the water level sensor 161 to determine whether or not the drain is normally performed.

The pump control unit 141 calculates power from the water level of the washing water detected by the water level sensor 161 and the current value of the current sensor 162 to determine whether the washing water remains (residual water) (S310). The pump control unit 141 determines a state where a part of the washing water remains as a residual water situation or a residual water state. When the washing water is drained and a part of the washing water remains in the drain passage or when a predetermined amount or less of washing water continuously flows into the drain passage during dewatering, the pump control unit 141 may determine a state of the washing water as the residual water state.

The speed sensor 163 detects a current speed of the pump motor 143 of the drain pump 145 (S320).

The pump control unit 141 determines whether or not the detected current speed exceeds a target speed (S330). When the current speed of the pump motor 143 is the target speed, the pump control unit 141 maintains a current state and continuously detects the speed through the speed sensor.

When the current speed of the pump motor exceeds the target speed, the pump control unit 141 determines whether or not the current speed is less than or equal to a sampling period (S340), and stores the current speed (S350) when the current speed is less than and equal to the sampling period.

When the current speed of the pump motor exceeds the target speed and reaches the sampling period, the pump control unit 141 compares a difference between the current speed and the target speed, that is, an excess value, with a set speed (S360). When the excess value exceeds the set speed, the pump control unit 141 decreases the target speed for the pump motor.

In this case, the pump control unit 141 may decrease the speed of the pump motor in a predetermined unit. For example, the pump control unit 141 may decrease the speed of the pump motor in a unit of 100 rpm.

The pump control unit 141 may decrease the speed of the pump motor using any one value within a range of 80 to 150 rpm as a first unit (A). The pump control unit may also decrease the target speed in a unit of 80 rpm or in a unit of 150 rpm. However, if any one value is set, the pump control unit decreases the target speed by designating the set value. That is, the pump control unit does not decrease the target speed by 80 rpm and then decrease the target speed by 100 rpm next time, but always decrease the target speed in a unit of 100 rpm at the time of decrease of the target speed in a case of changing the target speed in a unit of 100 rpm.

When the pump control unit 141 decreases the target speed, the pump control unit 141 determines whether or not the decreased target speed is less than a first limit speed, which is a minimum value among target speeds that may be set (S380), and sets the target speed to the first speed limit (S420) if the decreased target speed is less than the first limit speed.

On the other hand, when the excess value is less than or equal to the set speed (S360), the pump control unit increases the target speed (S400).

The pump control unit may increase the target speed using a value different from that of a case of decreasing the target speed as a second unit B. For example, the pump control unit may increase the target speed in a unit of 20 rpm. A unit for varying the target speed may be changed within a set range. The pump control unit may also increase the target speed in a unit of 10 rpm or 15 rpm.

The pump control unit 141 compares the increased target speed with a second limit speed (S410), and sets the second limit speed as the target speed when the target speed exceeds the second limit speed (S400).

On the other hand, when the changed target speed falls within a limit speed range, that is, when the changed target speed is equal to or greater than the first speed limit and is less than or equal to the second limit speed, the increased or decreased target speed is set as the target speed for controlling the pump motor (S430).

The pump control unit 141 generates a control signal for controlling the pump motor depending on the target speed and applies the control signal to the pump drive unit 142. The pump control unit 141 may apply a PWM control signal for controlling a switching circuit provided in the pump drive unit 142. The pump control unit 141 may change a duty of the PWM control signal depending on the target speed.

The pump drive unit 142 applies operation power having a predetermined magnitude to the pump motor 143 in response to the control signal, and accordingly, the pump motor rotationally operates depending on the target speed.

Accordingly, as the rotation speed of the pump motor is changed, the output of the drain pump is changed, such that the washing water is drained.

The pump control unit may set the speed of the pump motor corresponding to a current load state by increasing or decreasing the rotation speed of the pump motor as described above.

Figure 6:
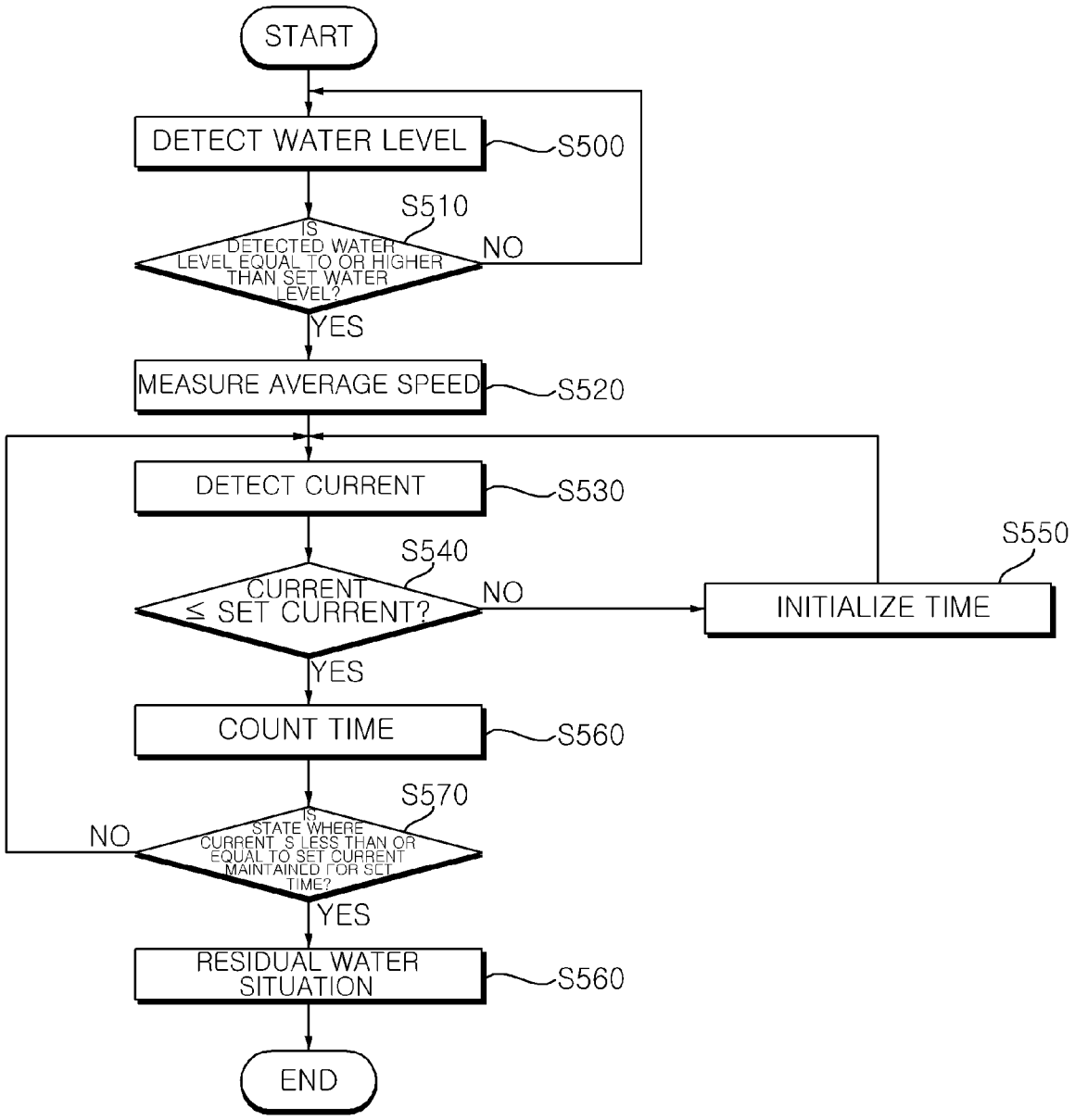
FIG. 6 is a flowchart illustrating a control method for draining washing water of the laundry treatment apparatus according to an embodiment of the present disclosure.

FIG. 6 is a flowchart illustrating a control method for draining washing water of the laundry treatment apparatus according to an embodiment of the present disclosure.

As illustrated in FIG. 6, the laundry treatment apparatus 1 drains the washing water if washing or rinsing is completed. The drain unit operates the drain pump to the drain the washing water to the outside through the drain passage.

The drain unit may determine whether or not a situation of the washing water is a residual water situation to control the operation of the drain pump as described above.

While the washing water is being drained, the water level sensor 161 detects the water level of the washing water (S500).

The pump control unit 141 compares the detected water level with a set water level (S510), and detects a current speed of the pump motor through the speed sensor when a current water level is equal to or higher than the set water level.

The pump control unit 141 calculates an average speed of the current speed for a predetermined time (S520).

The current sensor 162 detects a current of the operation power applied to the pump motor 143 by the pump drive unit 142 (S530).

The pump control unit 141 compares the detected current with a set current (S540), and counts a time when the detected current is less than or equal to the set current (S560).

On the other hand, when the detected current exceeds the set current, the pump control unit 141 initializes the time (S550) and then again compares a current value detected through the current sensor with the set current.

The pump control unit 141 determines whether or not a state where the detected current is less than or equal to the set current is maintained for a set time or longer (S570). When the state where the detected current is less than or equal to the set current is maintained for the set time or longer, the pump control unit 141 determines that a situation of the washing water is a residual water situation where a part of the washing water is not drained and remains (S580).

On the other hand, when the state where the detected current is less than or equal to the set current is not maintained for the set time or longer, that is, when the detected current exceeds the set current, the pump control unit 141 initializes the time and then counts again the time.

If it is determined that the situation of the washing water is the residual water situation, the pump control unit 141 increases or decreases the rotation speed of the pump motor to change the operation of the drain pump, thereby draining the residual water in the drain passage and preventing generation of the noise due to the residual water, as described above with reference to FIG. 5.

Accordingly, the present disclosure drains the washing water by changing the operation of the drain pump in a state where a part of the washing water remains. The present disclosure removes the residual water and prevents the generation of the noise due to the residual water by performing control to change the operation of the drain pump when a part of the washing water remains.

Although an exemplary embodiment of the present disclosure has been illustrated and described hereinabove, the present disclosure is not limited to the specific exemplary embodiment described above, and may be variously modified by those skilled in the art to which the present disclosure pertains without departing from the gist of the present disclosure as claimed in the claims. These modifications are to be understood to fall within the spirit and scope of the present disclosure.

DESCRIPTION OF REFERENCE NUMERALS

1: laundry treatment apparatus
110: control unit memory
130: motor drive unit motor
140: drain unit water supply unit
160: sensor unit pump control unit
142: pump drive unit pump motor
145: drain pump

What is claimed is:

1. A laundry treatment apparatus comprising:

a tub having a drum provided therein and providing a space in which washing water is stored;

a water level sensor detecting a water level of the washing water;

a control unit configured to determine a drain state for whether or not drain is normally performed in response to a change in the water level of the washing water detected by the water level sensor;

a drain pump configured to drain the washing water to an outside of the laundry treatment apparatus through a drain passage or to re-supply the washing water to the washing tub through a circulation passage;

a pump control unit configured to change an operation speed of the drain pump depending on a speed of the drain pump or a current value applied to the drain pump when a part of the washing water is not drained and is determined to remain as residual water in the drain passage according to the determination of the drain state by the control unit, wherein when the residual water is determined to be in the drain passage, the drain pump is configured to repeat a process of decreasing and then increasing the operation speed of the drain pump depending on a setting of the pump control unit and to drain the residual water from the drain passage; and a speed sensor configured to detect the operation speed of the drain pump, wherein the pump control unit is configured to increase the speed of the drain pump when a difference between the speed of the drain pump input from the speed sensor and a speed for controlling the drain pump is equal to or greater than a set value, and the pump control unit is configured to decrease the speed of the drain pump when the difference between the speed of the drain pump input from the speed sensor and the speed for controlling the drain pump is less than the set value, in response to the difference between the speeds, wherein the pump control unit is configured to decrease the speed of the drain pump in a first unit and to stepwise increase the decreased speed of the drain pump in a second unit smaller than the first unit.

2. The laundry treatment apparatus of claim 1, wherein the pump control unit stores a speed of the drain pump at which the washing water is drained without the residual water when the drain of the washing water is completed, and operates the drain pump at the stored speed at the next operation.

3. The laundry treatment apparatus of claim 1, wherein the pump control unit sets a speed range for the operation speed of the drain pump, and allows the drain pump to operate within the speed range.

4. The laundry treatment apparatus of claim 1, wherein the pump control unit sets the first unit within a range of 80 rpm to 150 rpm to decrease the speed of the drain pump, and sets the second unit within a range of 20 rpm to 50 rpm to increase the speed of the drain pump.

5. The laundry treatment apparatus of claim 1, further comprising a current sensor configured to detect a current applied to the drain pump, wherein the pump control unit changes the speed of the drain pump when the current detected by the current sensor is less than a set current.

6. The laundry treatment apparatus of claim 5, wherein the pump control unit changes the speed of the drain pump when a state where the current is less than the set current is maintained for a set time or longer, and the pump control unit maintains the speed of the drain pump when the current is changed to the set current or more before a time reaches the set time.

7. The laundry treatment apparatus of claim 1, wherein the control unit determines that the residual water has been generated when the difference between the speeds is equal to or greater than the set value, when the water level of the washing water is equal or higher than a set water level and the speed of the drain pump does not reach a set speed.

8. The laundry treatment apparatus of claim 5, wherein the control unit determines that the residual water has been generated when the water level of the washing water is equal or higher than a set water level and the current applied to the drain pump is less than the set current.

* * * * *